US011511988B2

(12) United States Patent
Meyer

(10) Patent No.: US 11,511,988 B2
(45) Date of Patent: Nov. 29, 2022

(54) NOZZLE HAVING A LOCKABLE CONTROL LEVER

(71) Applicant: ELAFLEX HIBY GMBH & CO. KG, Hamburg (DE)

(72) Inventor: Ulrich Meyer, Hamburg (DE)

(73) Assignee: ELAFLEX HIBY GMBH & CO. KG, Hamburg (DE)

( * ) Notice: Subject to any disclaimer, the term of this patent is extended or adjusted under 35 U.S.C. 154(b) by 0 days.

(21) Appl. No.: 17/761,259

(22) PCT Filed: Sep. 16, 2020

(86) PCT No.: PCT/EP2020/075791

§ 371 (c)(1),
(2) Date: Mar. 17, 2022

(87) PCT Pub. No.: WO2021/052975

PCT Pub. Date: Mar. 25, 2021

(65) Prior Publication Data

US 2022/0348452 A1 Nov. 3, 2022

(30) Foreign Application Priority Data

Sep. 18, 2019 (EP) ..... 19197972

(51) Int. Cl.
*B67D 7/50* (2010.01)

(52) U.S. Cl.
CPC ..... *B67D 7/50* (2013.01)

(58) Field of Classification Search
CPC ..... B67D 7/50; B67D 7/42
See application file for complete search history.

(56) References Cited

U.S. PATENT DOCUMENTS 10,703,623 B1 * 7/2020 Main ..... B67D 7/44
2011/0272063 A1 * 11/2011 Tumarkin ..... B67D 7/42
141/387

(Continued)

FOREIGN PATENT DOCUMENTS

EP 0286353 10/1988
GB 2134882 8/1984

OTHER PUBLICATIONS

International Search Report, International Patent Application No. PCT/EP2020/075791, dated Dec. 11, 2020, 2 pages.

*Primary Examiner* — Jason K Niesz
(74) *Attorney, Agent, or Firm* — Casimir Jones, S.C.; Brian F. Bradley

(57) ABSTRACT

The invention relates to a nozzle (13) for dispensing a fluid, comprising a manually operated control lever (15), which can be moved between a closed position and an open position in order to control the dispensing of the fluid. According to the invention, the control lever (15) comprises a latching pawl (23), which is designed to engage in a slotted guide (22) of the nozzle (13), the latching pawl (23) being designed to follow an opening movement of the control lever (15) in an opening direction (18) and a closing movement of the control lever (15) in a closing direction (18), the latching pawl (23) being able to be moved, by cooperation with the slotted guide (22), relative to the control lever (15) in a direction perpendicular to the opening and closing direction (18) into a catch position (25), in which the latching pawl (23) fixes the control lever (15) in the open position. Because of the interaction of the latching pawl (23) and the slotted guide (22), a locking device that is easy for the user to operate is created for the control lever by means of a simple design.

15 Claims, 1 Drawing Sheet

(56) References Cited

U.S. PATENT DOCUMENTS

Figure 1:
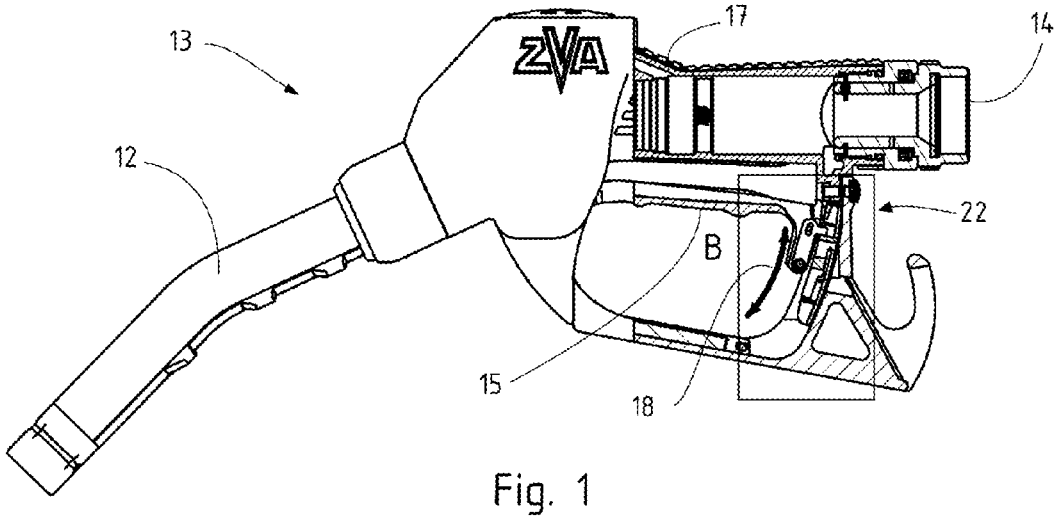

| | | | | |
|---|---|---|---|---|
| 2014/0130939 | A1* | 5/2014 | Kunter | B67D 7/50<br>141/351 |
| 2016/0347602 | A1 | 12/2016 | Clever et al. | |

* cited by examiner

NOZZLE HAVING A LOCKABLE CONTROL LEVER

The subject matter of the present invention is a filling nozzle for dispensing a fluid. The filling nozzle comprises a manually operatable control lever which, for controlling the dispensing of fluid, is movable between a closing position and an opening position.

Such filling valves are used for delivering a fuel into the tank of a vehicle, for example. To this end, the filling nozzle can be connected for example to a connector port of the tank. The control lever can subsequently be moved from the closing position to the opening position by means of the manual force of the user. On account thereof, a main valve is typically opened so as to enable the dispensing of fuel.

The main valve is typically urged into the closing position by a spring force. The user thus has to apply a certain force in order to keep the control lever in the opening position. This is laborious for the user over time. It is known from the obvious prior use to provide an arrester hook which can be pivoted with the aid of an additional manual movement in order for the control lever to be fixed in the opening position. However, the requirement of performing an additional manual movement renders the use uncomfortable.

It is furthermore known from DE 603 032 79 to provide an arrester device which enables the control lever to be arrested solely by moving the control lever into the opening position. To this end, the arrester device comprises a spring-loaded arm having a displaceable shuttle which enables a portion of the control lever to selectively latch in order for the control lever to be kept in the opening position. Releasing the arrester device takes place by moving the control lever in the opening direction. In this prior art it is disadvantageous that the arrester device is configured using small parts and is therefore prone to wear and complex in terms of maintenance.

A filling nozzle according to the preamble of claim 1 is furthermore known from document US 2016/0347602 A1.

Proceeding from this prior art, it is the object of the present invention to provide a filling nozzle of the type mentioned at the outset which has a possibility for arresting the control lever that is simple in terms of construction and easy to operate.

This object is achieved by the features of claim 1. Advantageous embodiments are described in the dependent claims. According to the invention, the control lever has an engaging pawl which is configured for engaging in a gate guide of the filling nozzle, wherein the engaging pawl is configured for following an opening movement of the control lever along an opening direction. Moreover, the engaging pawl is configured for following a closing movement of the control lever along a closing direction. Moreover, the engaging pawl by interacting with the gate guide is movable relative to the control lever along a direction perpendicular to the opening or closing direction into a catch position in which the engaging pawl fixes the control lever in the opening position.

First, some of the terms used in the context of the invention will be explained. When the engaging pawl is configured for following an opening movement or a closing movement of the control lever, this means that the engaging pawl is entrained by the control lever when the latter is moved.

The control lever can be connected in an articulated manner to a housing of the filling nozzle, for example, such that said control lever in an opening or closing movement performs a circular path. It is also possible for the control lever during the opening or closing movement to perform a (for example linear) displacement or a combination of displacement and pivoting. When the engaging pawl follows the opening or closing movement of the control lever, this means that the engaging pawl is likewise moved in the opening or closing direction, thus performs a circular movement or a linear movement or a combination thereof in the examples mentioned above. The movement perpendicular to the opening or closing direction is superimposed on the movement of the engaging pawl along the opening or closing direction. A movement is already considered "perpendicular to the opening or closing direction" when said movement does not run along the opening or closing direction. The engaging pawl per se, along the direction perpendicular to the opening or closing direction, can likewise perform a linear displacement, a rotating movement, or a superimposition of said movements, relative to the control lever.

The engaging pawl according to the invention engages in the gate guide and, on account thereof, is displaced by the gate guide such that said engaging pawl can reach a catch position. In the catch position, the engaging pawl fixes the control lever in the opening position. The gate guide can have a bearing face, for example, on which the engaging pawl bears in the catch position. On account thereof, forces exerted in the closing direction on the control lever can be directed into the bearing face by virtue of the connection to the engaging pawl. In this case, a counterforce is exerted on the engaging pawl in the catch position, said counterforce cancelling the opening force acting on the control lever such that the control lever remains in the opening position. It has been demonstrated that this design embodiment is able to be implemented in a reliable and simple manner in terms of construction and ensures that the control lever is securely fixed.

The engaging pawl is preferably disposed on a rear end of the control lever, said rear end being opposite a connection point of the control lever to the housing of the filling nozzle. The range of movement is at its greatest at this rear end, in particular in the case of a control lever which is connected in an articulated manner, this simplifying the guiding of the engaging pawl in the gate guide.

In one preferred embodiment the gate guide has a gate path along which the engaging pawl is movable, wherein the gate path has an initial position and the catch position, and wherein the gate path is preferably inherently closed. When the gate path is inherently closed, the engaging pawl can be moved along the gate path from the initial position by way of the catch position back to the initial position without a portion of the gate path having to be passed through twice. On account thereof, the motion sequence of the control lever can be unequivocally assigned a corresponding motion sequence of the engaging pawl within the gate guide, this increasing the operational reliability.

It can be provided that the engaging pawl is disposed in the initial position when the control lever is situated in the closing position. Proceeding from the initial position, the engaging pawl can then be moved along the gate path into the catch position by an opening movement of the control lever, so as to fix the control lever in the opening position. To this end, the gate guide can have a catch position entrance path along which the engaging pawl, proceeding from the initial position, is movable into the catch position. The catch position entrance path particularly preferably comprises a first portion along which the engaging pawl is entrained by a movement of the control lever in the opening direction, and a second portion along which the engaging pawl is entrained by a movement of the control lever in the closing direction. The first portion of the catch position entrance path can have an upper end which is defined by a detent which delimits the mobility of the control lever in the opening direction. It can be provided, for example, that the detent is configured for interacting with the engaging pawl. On account thereof, however, rather high forces would act on the engaging pawl when impacting the detent, which would necessitate a reinforced embodiment of the engaging pawl. It is therefore preferable when the detent is configured for interacting with the control lever or for interacting with a detent elements connected to the control lever. The movement of the control lever and thus also of the engaging pawl can in this way be delimited in the opening direction by the detent. On account of the reversal of the motion sequence at the end of the first portion, the user receives a tactile feedback which indicates to said user that the engaging pawl is being introduced into the catch position and the control lever will thus reliably arrive at the opening position as the movement continues.

The gate path preferably moreover has a catch position exit path along which the engaging pawl, proceeding from the catch position, is movable into the initial position, wherein the catch position exit path has a first portion along which the engaging pawl is entrained by a movement of the control lever in the opening direction, and a second portion along which the engaging pawl is entrained by a movement of the control lever in the closing direction. The first portion of the catch position exit path here can have an upper end which is formed by a detent which delimits the mobility of the control lever in the opening direction. Here too, it is preferable when the detent is configured for interacting with the control lever or for interacting with a detent element connected to the control lever. The movement along the first portion of the catch position exit path can be utilized for releasing the engaging pawl from the catch position. In this case, on account of the delimitation of the movement as well as the subsequent reversal of movement of the control lever when transitioning from the first portion to the second portion, also issued here to the user is a tactile feedback which indicates to said user that the engaging pawl is now free and the control lever can consequently be returned to the closing position.

According to the invention, the gate guide has at least one guide face for the engaging pawl, wherein the guide face conjointly with the opening or closing direction encloses an angle. A mobility of the engaging pawl perpendicular to the opening or closing direction in order for said engaging pawl to be directed into the catch position can be achieved in a simple manner by means of the guide face of the gate guide that is inclined in relation to the opening or closing direction.

According to the invention, the guide face comprises at least one directing portion which, by interacting with the engaging pawl, is able to be deflected counter to a restoring force. The directing portion is preferably able to be returned to a resting position by the restoring force. No restoring forces act on the directing portion in the resting position; in this case the directing portion can thus be deflected in an elastic manner.

The gate path preferably comprises at least one point of constriction which has a directing portion, and which in a movement of the control lever in a first direction is able to be passed by the engaging pawl in that the engaging pawl in passing deflects the directing portion. Further preferably, the point of constriction in a movement of the control lever in a second direction, counter to the first direction, blocks the gate path for the engaging pawl. By way of this design embodiment it can be achieved that the engaging pawl in the movement in the first direction can pass the point of constriction in that said engaging pawl deflects the directing portion, in particular in that said engaging pawl displaces said directing portion. Once the engaging pawl has passed the point of constriction in this way, a movement in the opposite direction through the point of constriction is no longer possible. On account of this design embodiment, the engaging pawl is thus deflected in a particularly effective and simple manner upon passing the point of constriction.

The point of constriction can be formed by the directing portion and a guide face which lies opposite said directing portion, wherein the spacing between the directing portion and the guide face is enlarged by the deflection of the directing portion in a movement of the control lever in the first direction, and wherein the spacing between the directing portion and the guide face is reduced by the deflection of the directing portion in a movement of the control lever in the second direction. The point of constriction can be disposed, for example, in the catch position entrance path, wherein in this case the first direction is the opening direction and the second direction is the closing direction. It is possible for further points of constriction to be provided at further points of the gate guide for the purpose of improving the deflection of the latching element, said further points of constriction ensuring a deflection of the engaging pawl in a reversal of the direction of movement of the control lever.

Figure 2:
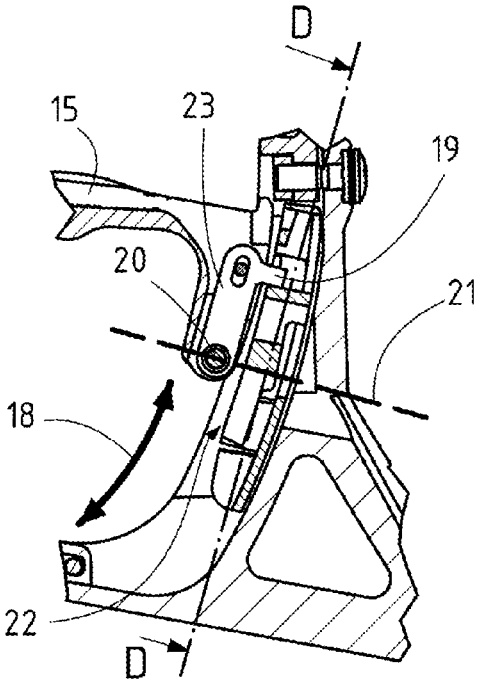
Figure 3:
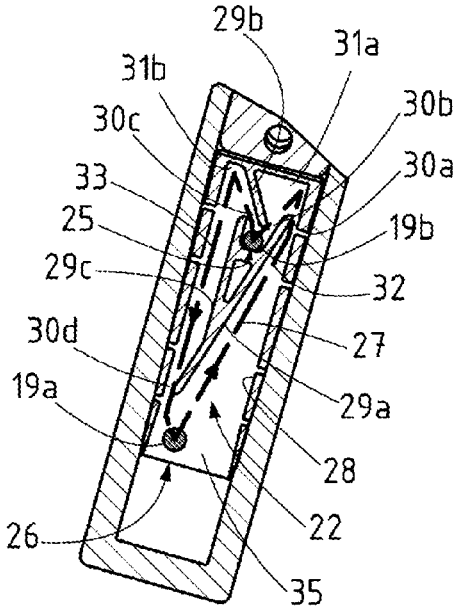

The invention will be explained in an exemplary manner hereunder by means of a preferred embodiment with reference to the appended drawings, in which:

FIG. 1: shows a longitudinal sectional view of a filling nozzle according to the invention;

FIG. 2: shows an enlarged lateral sectional view of the fragment B marked in FIG. 1; and FIG. 3: shows a cross-sectional view of a fragment of the filling nozzle according to the invention along the line D-D shown in FIG. 1.

FIG. 1 shows a longitudinal sectional view through a filling nozzle 13 according to the invention. The filling nozzle on the one side comprises a connector 14 for connecting the filling nozzle 13 to a fuel hose (not shown) and on the other side comprises an outlet pipe 12 which can be introduced into the tank of a motor vehicle, for example, so as to deliver fuel supplied by way of the connector 14 into the tank. The delivery of the fuel can be controlled with the aid of a control lever 15.

The control lever 15 is connected in an articulated manner to a housing 17 of the filling nozzle 13 and in a known manner is moreover connected to a main valve which, depending on the position of the control lever 15, enables or blocks the flow of the fuel through the filling nozzle. The movement of the control lever 15 takes place along an opening or closing direction which is identified by means of a double arrow 18 in FIG. 1. For the sake of simplicity, the opening direction as well as the closing direction hereunder will be identified by the reference sign 18. By virtue of the articulated connection between the control lever 15 and the housing 17, the direction 18 runs along a circular path. The opening or closing direction 18 thus also runs along a circular path.

A closing force acts on the control lever 15 such that an external force (for example the manual force of a user) counter to the closing force has to be applied in order for the control lever 15 to be moved from the closing into the opening position. In FIG. 1, the control lever 15 is situated in an opening position in which the flow of the fuel through the filling nozzle is enabled.

A gate guide 22 according to the invention is disposed on the filling nozzle 13, in which gate guide 22 engages an engaging pawl which cannot be seen in FIG. 1. The control lever 15 is able to be arrested in the opening position with the aid of the interaction of the gate guide 22 and the engaging pawl. This will be explained in detail hereunder with reference to FIGS. 2 and 3.

FIG. 2 shows an enlarged view of a fragment of FIG. 1, said fragment in the latter being identified by the letter B. It can be seen in the view of FIG. 2 that an engaging pawl 23 is fastened to the rear end of the control lever 15. The engaging pawl 23 is connected to the control lever 15 by way of an articulated connection 20 which prevents a movement of the engaging pawl 23 relative to the control lever 15 along the direction 18. The engaging pawl 23 in a movement of the control lever 15 along the direction 18 is therefore entrained by said control lever 15 and is moved conjointly with the control lever along the direction 18. In contrast, the articulated connection 20 enables a rotating movement of the engaging pawl 23 relative to the control lever 15 about the axis 21 which in FIG. 2 is indicated by a dashed line.

The engaging pawl 23 comprises a latching protrusion 19 which, by virtue of the rotatability about the axis 21, is movable in a direction perpendicular to the direction 18. The latching protrusion 19 engages in the gate guide 22 of the filling nozzle. On account of the mobility of the engaging pawl 23 along the axis 18 as well as the rotatability of the engaging pawl 23 about the axis 21, the latching protrusion 19 in a movement of the control lever 15 is guided within the gate guide 22.

In particular, the latching protrusion 19 in a movement of the control lever 15 from the closing into the opening position can be moved into a catch position of the gate guide 22. In this catch position, the engaging pawl 23 fixes the control lever 15 in the opening position such that the control lever 15 remains in the opening position even without an external force being applied. This will be explained hereunder with reference to FIG. 3.

FIG. 3 shows a cross section along the axis D-D shown in FIG. 1 in the region of the fragment identified by the letter B. It can be seen in this view that the gate guide 22 has a gate base 35 which is aligned so as to be parallel with the image plane of FIG. 3, as well as a plurality of wall elements 28, as well as a plurality of guide protrusions 29*a*, 29*b*, 29*c* which project from the gate base. The wall elements 28 and the guide protrusions 29*a*, 29*b*, 29*c* have guide faces which are at least in part inclined relative to the opening or closing direction 18. The guide faces define a gate path 27 along which the engaging pawl, or the latching protrusion 19 of the latter is movable. Different positions of the latching protrusion 19 are illustrated in FIG. 3 by the reference signs 19*a* and 19*b*. The gate path 27 comprises a catch position entrance path 32 which from an initial position 26 of the engaging pawl in an anti-clockwise manner leads to a catch position 25 of the engaging pawl. The gate path 27 moreover comprises a catch position exit path 33 which from the catch position 25 in an anti-clockwise manner leads back to the initial position 26. The catch position entrance path 32 and the catch position exit path 33 conjointly form a closed path.

Points of constriction 30*a*, 30*b*, 30*c*, 30*d* are formed at various positions of the gate path 27 between the guide faces of the guide protrusions 29*a*, 29*b*, 29*c* and the wall elements 28. The points of constriction 30*a*, 30*b*, 30*c*, 30*d* are distinguished in that the spacing between the guide faces that form the gate path is smaller than a cross-sectional extent of the latching protrusion along said spacing such that the latching protrusion initially cannot pass the points of constriction 30*a*, 30*b*, 30*c*, 30*d*. However, in the region of the points of constriction 30*a*-30*d*, the guide protrusions 29*a*, 29*b*, 29*c* are embodied so as to be movable and, on account thereof, form directing portions in the context of the present invention, said directing portions being deflectable counter to a restoring force. The directing portions can therefore be deflected by interacting with the latching protrusion 19 such that the latching protrusion 19 can overcome the points of constriction 30*a*, 30*b*, 30*c*, 30*d* along a predefined direction in this way. The deflection capability of the directing portions can be implemented in that, for example, said directing portions are formed from an elastic material, wherein a connection between the guide protrusions and the gate base 35 in the region of the deflecting portions is preferably weakened or interrupted such that the deflecting portions are movable relative to the gate base 35.

When the control lever 15 is moved out of the closing position in the direction of the opening position by the manual force of a user, the engaging pawl 23 or the latching protrusion 19 engaging in the gate guide 22 proceeding from the initial position 26 is moved upwards along the opening direction 18. Said latching protrusion 19 here encounters the guide protrusion 29*a* and by the inclined guide face situated there is moved substantially along the catch position entrance path 32 in the direction of the point of constriction 30*a* which is formed by a deflectable directing portion and a stationary guide face of a wall element 28 that lies opposite the directing portion.

Having arrived there, the latching protrusion 19 displaces the movable directing portion to the left in FIG. 3 and in this way enlarges the spacing between the directing portion and the stationary guide face. The latching protrusion 19 can then pass the point of constriction 30*a*.

After passing the point of constriction 30*a*, the latching protrusion 19 can still be moved a little further in the opening direction until the control lever 15 impacts on a detent not shown in the figures. The portion of the catch position entrance path 32 from the initial position to said upper end 31*a* of the catch position entrance path 32 is presently also referred to as the first portion of the catch position entrance path 32. The mobility of the control lever 15 as well as of the latching protrusion 19 in the opening direction is thus upwardly delimited by the detent.

In a subsequent movement of the control lever in the closing direction 18, the latching protrusion 19 is not guided through the point of constriction 30*a* once more, but is directed by guide faces of the guide protrusions 29*a*, 29*b*, 29*c* in the direction of the catch position 25. Said latching protrusion 19 here passes a further point of constriction 30*b* which is formed by two deflectable directing portions of the guide protrusions 29*a* and 29*b*. When passing the point of constriction 30*b*, the directing portion of the guide protrusion 29*a* is deflected to the right in FIG. 3, and the directing portion of the guide protrusion 29*b* is deflected to the left, such that the latching protrusion 19 can pass the point of constriction 30*b* and assume the catch position 25. The portion of the catch position entrance path 32 from the upper end 31*a* of the catch position entrance path 32 from the upper end 31*a* of the catch position entrance path 32 to the catch position 25 is presently also referred to as the second portion of the catch position entrance path 32.

In the catch position, the latching protrusion 19 bears on a bearing face of the gate guide 22 such that closing forces that are introduced into the engaging pawl 23 by way of the control lever 15 and act in the closing direction 18 are absorbed by the bearing face. In the catch position 25, the bearing face is moreover laterally delimited by upwardly-pointing guide faces of the guide protrusions 29*a*, 29*c* such that the latching protrusion 19 is held securely in the catch position. The control lever 15 is therefore fixed by the latching protrusion 19 situated in the catch position such that the fueling procedure can be performed in a comfortable manner without the user having to manually apply an opening force.

Upon completion of the fueling procedure, the user can bring the control lever 15 back into the closing position in that said user initially moves the control lever 15 in the opening direction, on account of which the latching protrusion 19 from the catch position 25 is moved along the catch position exit path 33 (along a first portion of the catch position exit path 33) to an upper end 31*b* of the catch position exit path 33. The upper end of the catch position exit path 33, like the upper end of the catch position entry path 32, is defined by a detent which is not shown in the figures, the mobility of the control lever 15 (and thus also of the latching protrusion 19) being delimited in the opening direction by said detent. In the subsequent movement of the control lever 15 as well as of the latching protrusion 19 in the closing direction 18, the latching protrusion 19 follows the remaining part of the catch position exit path 33 (second portion of the catch position exit path 33) and by way of the point of constriction 30*d* returns back to the initial position 26. The point of constriction 30*b* which can be passed only in one direction, in a manner analogous to the manner already described above, ensures that the latching protrusion 19 makes its way into the catch position exit path 33 as desired and does not run backwards through the catch position entrance path 32. The further point of constriction 30*d* serves for directing the latching protrusion 19 into the catch position entrance path 32 in a subsequent new fueling procedure.

The invention claimed is:

1. Filling nozzle (13) for dispensing a fluid, having a manually operatable control lever (15) which, for controlling the dispensing of fluid, is movable between a closing position and an opening position and which has an engaging pawl (23) which is configured for engaging in a gate guide (22) of the filling nozzle (13), wherein the engaging pawl (23) is configured for following an opening movement of the control lever (15) along an opening direction (18) as well as a closing movement of the control lever (15) along a closing direction (18), wherein the engaging pawl (23) by interacting with the gate guide (22) is movable relative to the control lever (15) along a direction perpendicular to the opening or closing direction (18) into a catch position (25) in which the engaging pawl (23) fixes the control lever (15) in the opening position, characterized in that the gate guide (22) has at least one guide face for the engaging pawl (23) that conjointly with the opening or closing direction (18) encloses an angle, wherein the guide face comprises at least one directing portion which, by interacting with the engaging pawl (23), is able to be deflected counter to a restoring force.

2. Filling nozzle according to claim 1, wherein the directing portion is able to be returned to a resting position by the restoring force.

3. Filling nozzle according to claim 2, wherein the gate path (27) has at least one point of constriction (30*a*, 30*b*, 30*c*, 30*d*) which comprises the directing portion and which in a movement of the control lever (15) in a first direction is able to be passed by the engaging pawl (23) in that the engaging pawl (23) in passing deflects the directing portion, wherein the point of constriction (30*a*, 30*b*, 30*c*, 30*d*) in a movement of the control lever (15) in a second direction, counter to the first direction, blocks the gate path (27) for the engaging pawl (23).

4. Filling nozzle according to claim 3, wherein the point of constriction (30*a*, 30*b*, 30*c*, 30*d*) is formed by the directing portion and a guide face which lies opposite said directing portion, wherein the spacing between the directing portion and the guide face is enlarged by the deflection of the directing portion in a movement of the control lever (15) in the first direction, and wherein the spacing between the directing portion and the guide face is reduced by the deflection of the directing portion in a movement of the control lever (15) in the second direction.

5. Filling nozzle according to claim 3, wherein the point of constriction (30*a*) is disposed in the catch position entrance path (32), wherein the first direction is the opening direction and the second direction is the closing direction.

6. Filling nozzle according to claim 3, wherein the point of constriction (30*b*) is disposed in the catch position entrance path (32), wherein the first direction is the closing direction and the second direction is the opening direction.

7. Filling nozzle according to claim 3, wherein the point of constriction (30*c*) is disposed in the catch position exit path (33), wherein the first direction is the opening direction and the second direction is the closing direction, and/or wherein the point of constriction (30*d*) is disposed in the catch position exit path (33), wherein the first direction is the closing direction and the second direction is the opening direction.

8. Filling nozzle according to claim 1, wherein the gate guide (22) has a gate path (27) along which the engaging pawl (23) is movable, wherein the gate path (27) has an initial position (26) and the catch position (25).

9. Filling nozzle according to claim 8, wherein the gate path (27) is inherently closed.

10. Filling nozzle according to claim 8, wherein the gate path (27) has a catch position entrance path (32) along which the engaging pawl (23), proceeding from the initial position (26), is movable into the catch position (25).

11. Filling nozzle according to claim 10, wherein the catch position entrance path (32) has a first portion along which the engaging pawl is entrained by a movement of the control lever (15) in the opening direction (18), and a second portion along which the engaging pawl (23) is entrained by a movement of the control lever (15) in the closing direction.

12. Filling nozzle according to claim 11, wherein the first portion of the catch position entrance path (32) has an upper end (31*a*) which is formed by a detent for the engaging pawl (23) and/or for the control lever (15).

13. Filling nozzle according to claim 8, wherein the gate path (27) has a catch position exit path (33) along which the engaging pawl (23), proceeding from the catch position (25), is movable into the initial position (26).

14. Filling nozzle according to claim 13, wherein the catch position exit path (33) has a first portion along which the engaging pawl (23) is entrained by a movement of the control lever (15) in the opening direction (18), and a second portion along which the engaging pawl (23) is entrained by a movement of the control lever (15) in the closing direction (18).

15. Filling nozzle according to claim 14, wherein the first portion of the catch position exit path (33) has an upper end (31*b*) which is formed by a detent for the engaging pawl (23) and/or for the control lever (15).

* * * * *